US010599079B2

(12) United States Patent
Iguchi

(10) Patent No.: US 10,599,079 B2
(45) **Date of Patent: *Mar. 24, 2020**

(54) IMAGE FORMING APPARATUS AND IMAGE FORMING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Ken Iguchi, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/217,106

(22) Filed: Dec. 12, 2018

(65) Prior Publication Data

US 2019/0113869 A1 Apr. 18, 2019

Related U.S. Application Data

(63) Continuation of application No. 15/712,541, filed on Sep. 22, 2017, now Pat. No. 10,185,261.

(51) Int. Cl.
*G03G 15/20* (2006.01)
*G03G 15/04* (2006.01)
(Continued)

(52) U.S. Cl.
CPC ... *G03G 15/2053* (2013.01); *G03G 15/04036* (2013.01); *G03G 15/18* (2013.01);
(Continued)

(58) Field of Classification Search
CPC ..... G03G 15/0436; G03G 15/18; G03G 15/2039; G03G 15/2078; G03G 21/1641
(Continued)

(56) References Cited

U.S. PATENT DOCUMENTS 7,190,911 B2 3/2007 Sato et al.
8,068,749 B2 * 11/2011 Mukai ..... G03G 15/2039 399/122
(Continued)

FOREIGN PATENT DOCUMENTS

JP 2006-72235 3/2006
JP 2013-117571 6/2013

OTHER PUBLICATIONS

Non-Final Office Action for U.S. Appl. No. 15/712,541 dated Feb. 16, 2018.

*Primary Examiner* — Hoan H Tran
(74) *Attorney, Agent, or Firm* — Amin, Turocy & Watson, LLP

(57) ABSTRACT

In accordance with an embodiment, an image forming apparatus encompasses a heat roller, a lamp, a use amount acquisition section, a switching controller and a cycle controller. The heat roller heats a sheet printed with a toner image. The lamp heats the heat roller. The use amount acquisition section acquires a use amount of the lamp. The switching controller repeats a processing from a moment at which the lamp is charged until the lamp is charged next after the lamp is not charged in a predetermined control cycle. The cycle controller sets the cycle based on the use amount.

18 Claims, 8 Drawing Sheets

(51) Int. Cl.
*G03G 15/18* (2006.01)
*G03G 15/00* (2006.01)
*G03G 15/045* (2006.01)

(52) U.S. Cl.
CPC ..... *G03G 15/6585* (2013.01); *G03G 15/045* (2013.01); *G03G 15/2039* (2013.01)

(58) Field of Classification Search
USPC ..... 399/38, 67–70, 122, 320, 328–334
See application file for complete search history.

(56) References Cited

U.S. PATENT DOCUMENTS

| | | | | |
|---|---|---|---|---|
| 8,103,183 | B2 | 1/2012 | Nemoto et al. | |
| 8,526,836 | B2 | 9/2013 | Mitsuoka et al. | |
| 8,682,192 | B2 | 3/2014 | Ikebuchi et al. | |
| 9,188,920 | B2 * | 11/2015 | Kawahata ..... | G03G 15/2021 |
| 10,185,261 | B1 * | 1/2019 | Iguchi ..... | G03G 15/2053 |

* cited by examiner

FIG.5

D101

| CONDITION | | CONTROL CONTENT | |
|---|---|---|---|
| CURRENT ACQUISITION TEMPERATURE ≥LAST ACQUISITION TEMPERATURE | CURRENT ACQUISITION TEMPERATURE IS SMALLER THAN TEMPERATURE T1 | 80%ON | R1 |
| CURRENT ACQUISITION TEMPERATURE ≥LAST ACQUISITION TEMPERATURE | CURRENT ACQUISITION TEMPERATURE IS EQUAL TO OR HIGHER THAN TEMPERATURE T1 AND SMALLER THAN TEMPERATURE T2 | 50%ON | R2 |
| CURRENT ACQUISITION TEMPERATURE ≥ LAST ACQUISITION TEMPERATURE<br>CURRENT ACQUISITION TEMPERATURE < LAST ACQUISITION TEMPERATURE | CURRENT ACQUISITION TEMPERATURE IS HIGHER THAN TEMPERATURE T2 | 0%ON | |
| CURRENT ACQUISITION TEMPERATURE <LAST ACQUISITION TEMPERATURE | CURRENT ACQUISITION TEMPERATURE IS EQUAL TO OR HIGHER THAN TEMPERATURE T1 AND SMALLER THAN TEMPERATURE T2 | 80%ON | |
| CURRENT ACQUISITION TEMPERATURE <LAST ACQUISITION TEMPERATURE | CURRENT ACQUISITION TEMPERATURE IS SMALLER THAN TEMPERATURE T1 | 100%ON | |

FIG.6

D201

| APPARATUS STATE | THRESHOLD VALUE |
|---|---|
| PRINTING BY DECOLORING TONER | FIRST THRESHOLD VALUE |
| PRINTING BY NON-DECOLORING PRINTING | SECOND THRESHOLD VALUE |
| STANDBY | THIRD THRESHOLD VALUE |

IMAGE FORMING APPARATUS AND IMAGE FORMING METHOD

CROSS-REFERENCE TO RELATED APPLICATION

This application is a Continuation of application Ser. No. 15/712,541 filed on Sep. 22, 2017, the entire contents of which are incorporated herein by reference.

FIELD

Embodiments described herein relate generally to an image forming apparatus and an image forming method.

BACKGROUND

Conventionally, in a fixing process of an image forming apparatus, as a departure between an actual temperature and a target temperature of a nip part heated by a lamp is suppressed, a duty control for repeating an ON state and an OFF state of the lamp which is a heating source in a short cycle is executed. However, in the conventional duty control, as a switching frequency of the ON state and the OFF state of the lamp increases, the lifetime of the lamp undesirably decreases.

BRIEF DESCRIPTION OF THE DRAWINGS

FIG. 5 is a diagram illustrating an example of a second duty control table;

FIG. 6 is a diagram illustrating an example of a control method switching condition table;

DETAILED DESCRIPTION

In accordance with an embodiment, an image forming apparatus comprises a heat roller, a lamp, a use amount acquisition section, a switching controller and a cycle controller. The heat roller heats a sheet printed with a toner image. The lamp heats the heat roller. The use amount acquisition section acquires a use amount of the lamp. The switching controller repeats a processing from a moment at which the lamp is charged until the lamp is charged next after the lamp is not charged in a predetermined control cycle. The cycle controller sets the cycle based on the use amount.

In accordance with another embodiment, image forming method involves heating a heat roller with a lamp; heating a sheet printed with a toner image with the heat roller; acquiring a use amount of the lamp; repeating a processing from a moment at which the lamp is charged until the lamp is charged next after the lamp is not charged in a predetermined control cycle; and setting a cycle based on the use amount.

Hereinafter, an image forming apparatus and an image forming method of an embodiment are described with reference to the accompanying drawings.

The "decoloring processing" in the present embodiment is a processing of decoloring an image formed on a sheet. The "decoloring" in the present embodiment means making an image formed by a color (including not only chromatic color but also achromatic colors such as white and black) different from a color of a base of the sheet visually invisible. The decoloring may be executed by a method other than decoloring by heating. The sheet is, for example, a document, a paper on which characters, images are recorded, and may be an optional object as long as it can be read by an image forming apparatus 1 of the present embodiment.

Figure 1:
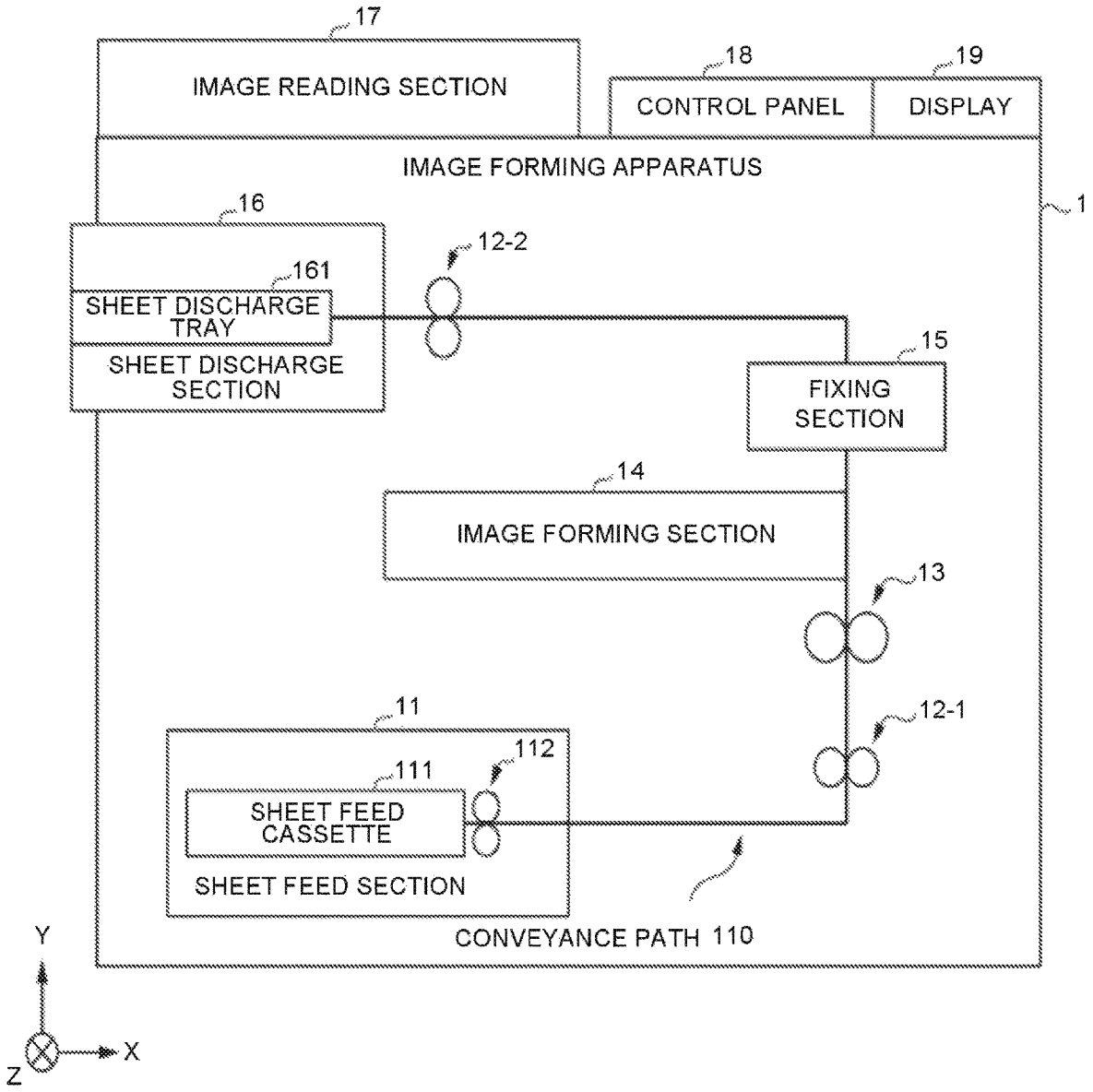
FIG. 1 is a sectional view schematically illustrating an image forming apparatus according to an embodiment.

FIG. 1 is a sectional view schematically illustrating an image forming apparatus 1 according to the present embodiment.

The image forming apparatus 1 of the embodiment executes an image forming processing and a decoloring processing. The image forming processing forms an image on a sheet. The decoloring processing decolorizes the image formed on the sheet. The image forming apparatus 1 is, for example, an MFP (Multi-Function Peripheral). The image forming apparatus 1 reads an image shown on the sheet and generates digital information to generate an image file.

The image forming apparatus 1 includes a sheet feed section 11, a conveyance roller 12, a resist roller 13, an image forming section 14, a fixing section 15, a sheet discharge section 16, an image reading section 17, a control panel 18 and a display 19. The sheet is conveyed on a conveyance path 110 shown in FIG. 1 from the sheet feed section 11 to the sheet discharge section 16.

The sheet feed section 11 feeds the sheet. Specifically, the sheet feed section 11 includes a sheet feed cassette 111 and a pickup roller 112. The sheet feed cassette 111 houses the sheet. The pickup roller 112 picks up the sheets one by one from the sheet feed cassette 111 to send the sheet to a conveyance path of the image forming apparatus 1. A plurality of sheet feed cassettes 111 may be provided. If there is a plurality of the sheet feed cassettes 111, each pickup roller 112 is arranged for each cassette.

Conveyance rollers 12-1 and 12-2 convey the sheet. The conveyance roller 12-1 conveys the sheet supplied by the pickup roller 112 to the resist roller 13. The conveyance roller 12-2 conveys the sheet from the fixing section 15 to the sheet discharge section 16.

The resist roller 13 enables the sheet to stand by until a temperature of a nip part of the fixing section 15 reaches a predetermined temperature, and sends it to the conveyance path if the predetermined temperature is reached.

The image forming section 14 forms an image indicated by image data on the sheet based on the image data of the image to be formed. For example, the image data may be generated by the image reading section 17 or received via a communication section (not shown). The image forming section 14 forms an image with a toner which is a decoloring recording agent (hereinafter, referred to as a "decoloring toner") and a toner which is a non-decoloring recording agent (hereinafter, referred to as a "non-decoloring toner"). The non-decoloring toner is toner of yellow (Y), magenta (M), cyan (C), and black (K). The decoloring toner is a colored toner, which is similar to the non-decoloring toner, and is, for example, black. The decoloring toner is decolorized at a predetermined temperature (hereinafter, referred to as a "decoloring temperature") higher than a temperature (hereinafter, referred to as a "fixing temperature") at which the non-decoloring toner is fixed on the sheet. The image forming section 14 executes the image forming processing and the decoloring processing by the decoloring toner or the non-decoloring toner. In the description below, the image forming processing by the decoloring toner is described as a decoloring printing, and the image forming processing by the non-decoloring toner is described as a non-decoloring printing. If it is not particularly necessary to distinguish the two below, the decoloring toner and the non-decoloring toner are merely described as a toner.

The fixing section 15 fixes a toner image transferred onto the sheet by the image forming section 14 due to heating of the sheet or decolorizes an image formed by the decoloring toner. The fixing section 15 fixes the toner on the sheet by heating the sheet at the fixing temperature or decolorizes the decoloring toner fixed on the sheet by heating the sheet to the decoloring temperature.

The sheet discharge section 16 is a discharge destination of the sheet on which the image forming processing or the decoloring processing is executed. The sheet discharge section 16 has a sheet discharge tray 161. The sheet on which the image forming processing or the decoloring processing is executed is discharged on the sheet discharge tray 161.

The image reading section 17 is an image sensor such as a CCD (Charge Coupled Device) or a COMS (Complementary Metal Oxide Semiconductor) sensor. The image reading section 17 reads image information which is a reading object as intensity of light. The image reading section 17 stores the read image data in, for example, an auxiliary storage device 24 described later. The stored image data may be transmitted to another information processing apparatus via a network.

The control panel 18 includes a plurality of buttons. The control panel 18 receives an operation by a user. The control panel 18 outputs a signal in response to the operation executed by the user to a controller (not shown) of the image forming apparatus 1.

The display 19 is an image display device such as a liquid crystal display, an organic EL (Electro Luminescence) display, and the like. The display 19 displays various information on the image forming apparatus 1. Furthermore, the control panel 18 and the display 19 may be integrally formed using a touch panel.

Figure 2:
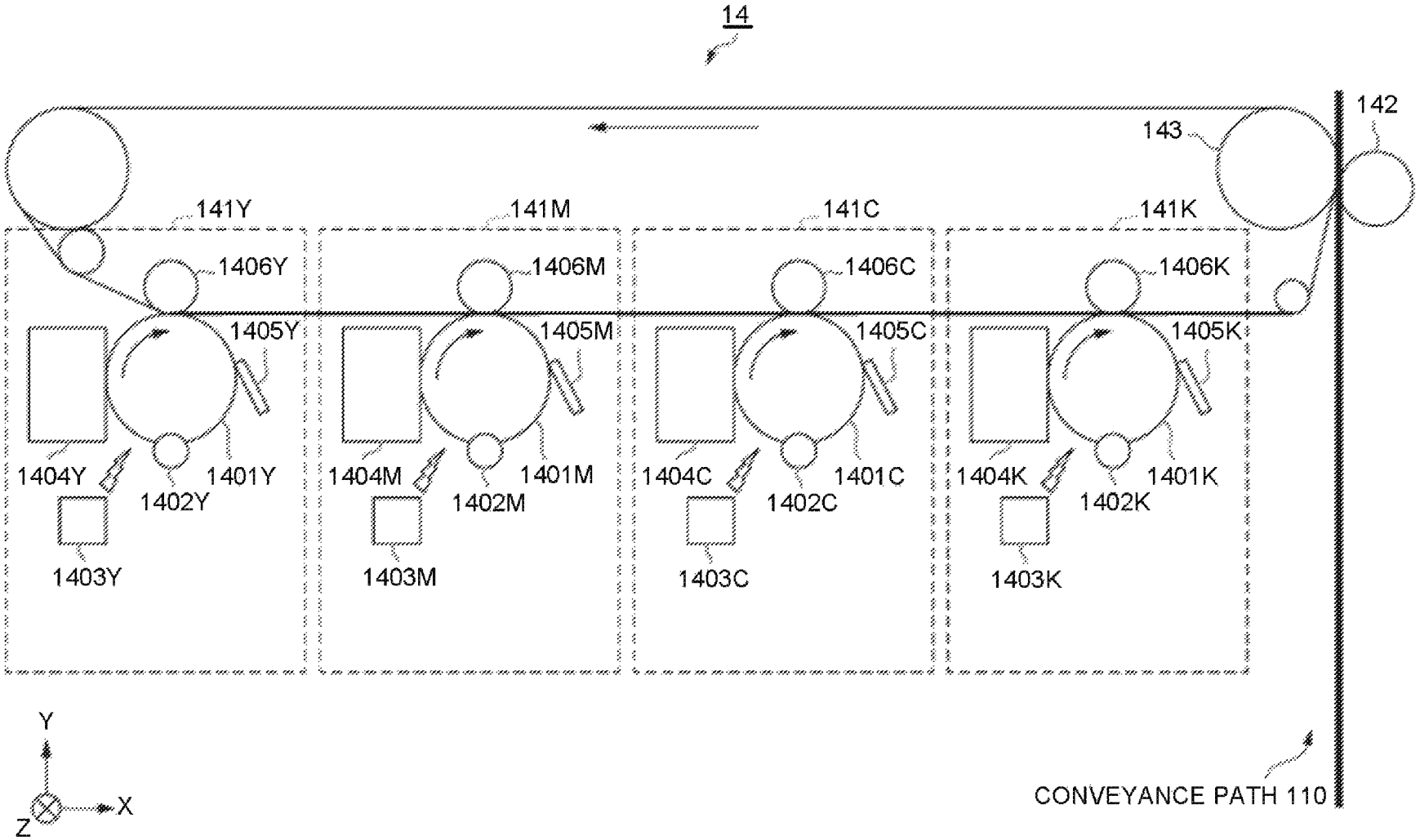
FIG. 2 is a diagram exemplifying the constitution of an image forming section.

FIG. 2 is a diagram exemplifying the constitution of the image forming section 14. The image forming section 14 includes a processing unit 141, a secondary transfer roller 142 and a secondary transfer opposite roller 143 for each color. In FIG. 2, the above functional sections corresponding to yellow, magenta, cyan and black are distinguished by Y, M, C and K, respectively. For example, 141-K represents a processing unit 141 for yellow.

The processing unit 141 forms the toner image on an intermediate transfer belt 144 which is an endless belt. The processing unit 141 includes a photoconductive drum 1401, a charging device 1402, an exposure device 1403, a developing device 1404, a photoconductive cleaner 1405 and a primary transfer roller 1406. In FIG. 2, similar to the processing unit 141, the functional sections corresponding to yellow, magenta, cyan, and black are distinguished by Y, M, C and K, respectively. For example, 1401-M represents the photoconductive drum 1401 for magenta.

The photoconductive drum 1401 generates an electrostatic latent image on the surface thereof. The photoconductive drum 1401, which is an image carrier, is a columnar drum. The photoconductive drum 1401 has a photoreceptor substance on an outer peripheral surface thereof and has the property of releasing static electricity only at the portion irradiated with the light. The charging device 1402 charges the surface of the photoconductive drum 1401 with static electricity.

The charging device 1402 is, for example, a needle electrode. The exposure device 1403 forms an electrostatic latent image of the image to be formed on the surface of the photoconductive drum 1401. The exposure device 1403 is, for example, a laser irradiation device. The developing device 1404 supplies the toner to the surface of the photoconductive drum 1401 and develops the electrostatic latent image with the toner.

The photoconductive cleaner 1405 removes the residual toner on the photoconductive drum 1401. The removed toner is collected in a waste toner tank (not shown) to be discarded. The primary transfer roller 1406 transfers the electrostatic latent image developed on the surface of the photoconductive drum 1401 onto the intermediate transfer belt 144.

The secondary transfer roller 142 transfers the toner image on the intermediate transfer belt 144 onto the sheet. The secondary transfer opposite roller 143 exists at a position facing the secondary transfer roller 142 across the intermediate transfer belt 144 and sandwiches the sheet with the secondary transfer roller 142 to convey the sheet onto which the image is transferred.

Figure 3:
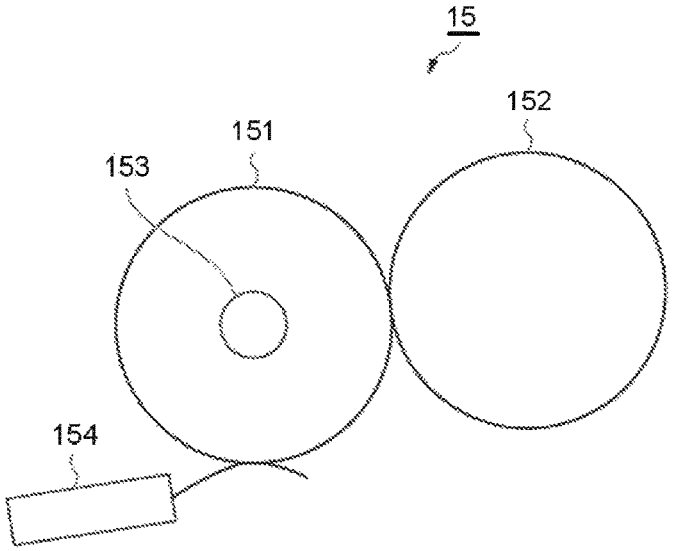
FIG. 3 is a diagram exemplifying the constitution of a fixing section.

FIG. 3 is a diagram exemplifying the constitution of the fixing section 15. The fixing section 15 includes a heat roller 151, a pressure roller 152, a heat lamp 153 and a thermistor 154.

The heat roller 151 heats the sheet for fixing or the decolorizing the image transferred onto the sheet. For example, the heat roller 151 is formed in a cylindrical shape. The heat roller 151 has the heat lamp 153 therein. The heat roller 151 heats the sheet by the heat lamp 153.

The pressure roller 152 presses the sheet against the heat roller 151 oppositely arranged. The contact surface formed by the pressing is a nip part.

The heat lamp 153 is turned on or off under the control of a switching controller 241 described below. The heat lamp 153 is, for example, a halogen lamp. The lighting is a state in which the heat lamp 153 is charged. The extinction is a state in which the heat lamp 153 is not charged.

The thermistor 154 measures a surface temperature of the heat roller 151. The surface temperature of the heat roller 151 measured by the thermistor 154 is approximately the same as the temperature of the nip part. Thus, the resist roller 13 is controlled to convey the sheet based on the surface temperature of the heat roller 151 measured by the thermistor 154. The thermistor 154 outputs information indicating the measured surface temperature of the heat roller 151 to the fixing controller 23 described below.

Figure 4:
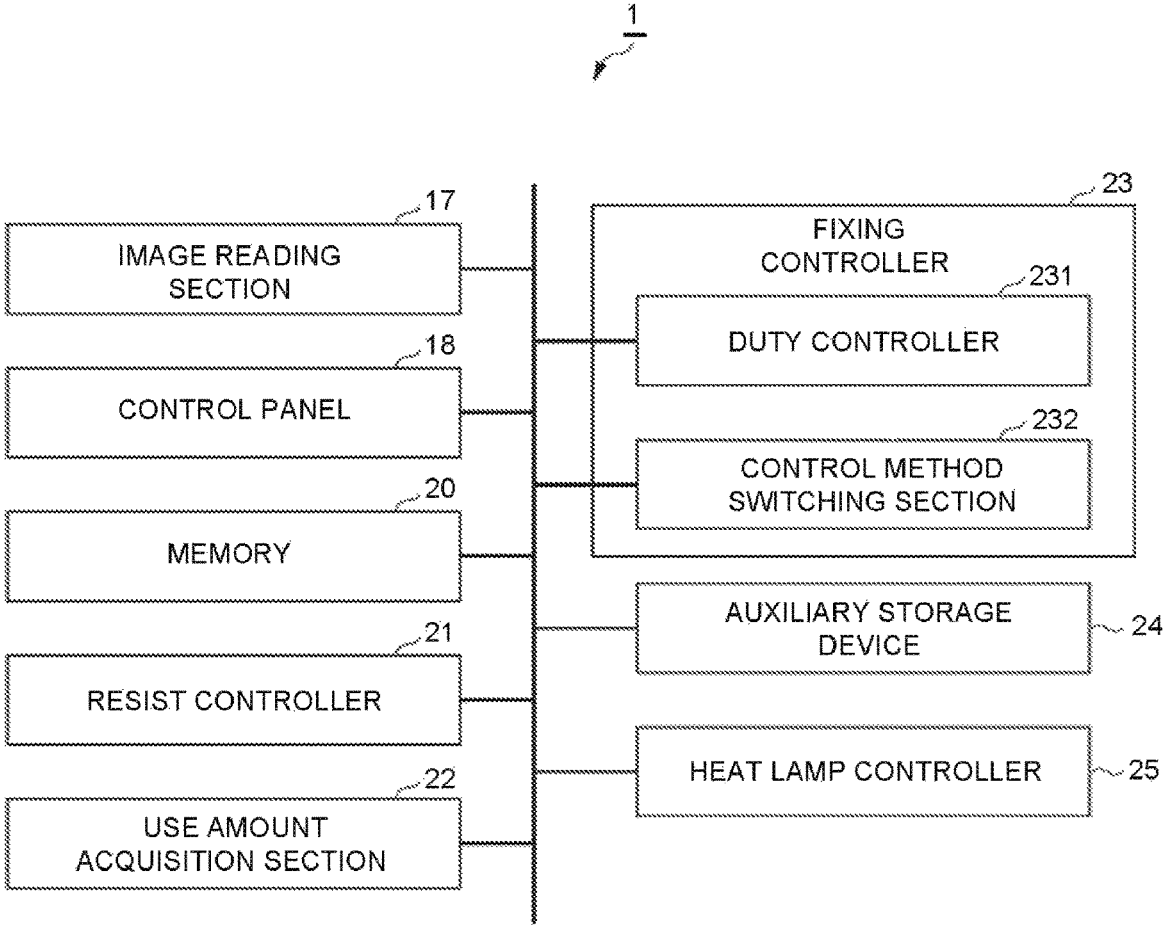
FIG. 4 is a schematic block diagram exemplifying the functional components relating to a control by the image forming apparatus.

FIG. 4 is a schematic block diagram exemplifying the functional components relating to a control by the image forming apparatus 1. The image forming apparatus 1 includes with a CPU (Central Processing Unit), a memory 20, and an auxiliary storage device 24 connected by a bus line, and executes a program to function as a device including the image reading section 17, the control panel 18, a resist controller 21, an use amount acquisition section 22, a fixing controller 23, an auxiliary storage device 24 and a heat lamp controller 25. All or a part of the functions of the image forming apparatus 1 may be realized by using hardware such as ASIC (Application Specific Integrated Circuit), PLD (Programmable Logic Device), FPGA (Field Programmable Gate Array) or the like. The program may be recorded on a computer-readable recording medium. The computer-readable recording medium is a storage device such as a portable medium such as a flexible disk, a magneto-optical disk, a ROM, a CD-ROM, or a hard disk built in a computer system. The program may be transmitted via an electric communication line.

The memory 20 temporarily stores information used by each functional section of the image forming apparatus 1. The memory 20 is, for example, a semiconductor memory. The memory 20 may store the digital information generated by the image reading section 17.

The resist controller 21 controls operation conditions of the roller such as a rotation speed and a rotation direction of the roller of the resist roller 13.

The use amount acquisition section 22 acquires information indicating the use amount of the heat lamp 153. The use amount acquisition section 22 is, for example, a CPU. The use amount of the heat lamp 153 is the number of times the heat lamp 153 is turned off. The use amount of the heat lamp 153 may be the number of times the heat lamp 153 is lit or may be a lighting time of the heat lamp 153. In this case, the use amount acquisition section 22 acquires a signal indicating that the heat lamp controller 25 controls the heat lamp 153 and acquires the information indicating the use amount of the heat lamp 153. The use amount of the heat lamp 153 may be the number of the sheets on which image formation is executed by the image forming apparatus 1. In this case, the use amount acquisition section 22 acquires a signal indicating that the resist controller 21 controls the resist roller 13 and acquires the information indicating the use amount of the heat lamp 153. The use amount of the heat lamp 153 may be a driving time of the heat roller 151. In this case, the use amount acquisition section 22 acquires a signal indicating that the fixing controller 23 controls the heat roller 151 and acquires the information indicating the use amount of the heat lamp 153.

The fixing controller 23 controls the fixing section 15. The fixing controller 23 includes a duty controller 231 and a control method switching section 232. The duty controller 231 executes either a first duty control or a second duty control. The first duty control is a control method for switching lighting and extinction of the heat lamp 153. For example, the first duty control switches lighting and extinction of the heat lamp 153 depending on whether the surface temperature of the heat roller 151 exceeds a target temperature. The second duty control switches lighting and extinction of the heat lamp 153 at a shorter time interval than the first duty control. The second duty control switches lighting and extinction by changing a ratio of the lighting time of the heat lamp 153 based on the surface temperature of the heat roller 151. The fixing controller 23 acquires the information on the surface temperature of the heat roller 151 measured by the thermistor 154 at a predetermined interval (e.g., 100 ms increments).

The control method switching section 232 switches the control method executed by the duty controller 231. The control method switching section 232 switches the control method between the first duty control and the second duty control. The control method switching section 232 switches the control method between the first duty control and the second duty control according to a predetermined condition based on the use amount of the heat lamp 153 acquired by the use amount acquisition section 22.

The auxiliary storage device 24 stores image data of an image read by the image reading section 17, and information input from another information processing apparatus. The auxiliary storage device 24 is, for example, a hard disk or an SSD (Solid State Drive). The auxiliary storage device 24 stores various information. The various information includes a second duty control table D101, a control method switching condition table D201, and the like. The second duty control table D101 is a table in which the conditions of the second duty control by the duty controller 231 are registered. The control method switching condition table D201 is a table in which conditions for switching the duty control between the first duty control and the second duty control by the control method switching section 232 are registered.

FIG. 5 is a diagram illustrating an example of the second duty control table D101. The second duty control table D101 has a plurality of records indicating information on the second duty control. Each record has each value of "condition" and "control content". The value of "condition" indicates a condition at the time of execution of the second duty control. The value of "control content" indicates the content of control executed if the condition is satisfied. The current acquisition temperature indicates the latest temperature acquired by the thermistor 154. The last acquisition temperature indicates a temperature acquired by the thermistor 154 immediately before the temperature acquired this time. For example, R1 in FIG. 5 shows that the heat lamp 153 is controlled in such a manner that a lighting time is 80% and an extinction time is 20% if the current acquisition temperature≥the last acquisition temperature and the current acquisition temperature is less than a temperature T1. The lighting time and the extinction time are the lighting time and the extinction time of the heat lamp 153 in one cycle. One cycle is from a moment the heat lamp 153 is turned on and then is turned off until the heat lamp 153 is turned on next. Hereinafter, a value indicating the ratio of the lighting time to one cycle as a percentage is referred to as a duty ratio. The duty ratio is 100*lighting time/(lighting time+extinction time).

FIG. 6 is a diagram illustrating an example of the control method switching condition table D201. The control method switching condition table D201 has a record for each value of an "apparatus state". Each record has a value of "the apparatus state" and a value of a "threshold value". The "apparatus state" has a value indicating an operation state of the image forming apparatus 1. The "apparatus state" has values indicating a 'printing by decoloring toner', a 'printing by non-decoloring toner' and a 'standby'. The 'printing by decoloring toner' indicates that a state in which the image forming apparatus 1 executes the image formation with the decoloring toner. The 'printing by non-decoloring toner' indicates a state in which the image forming apparatus 1 executes the image formation with the non-decoloring toner. The 'standby' indicates a state (hereinafter, referred to as a "standby state") of the image forming apparatus 1 in which information instructing the image forming apparatus 1 to execute the decoloring printing or the non-decoloring printing is not input by the control panel 18. The "threshold value" has a value indicating a threshold value at the time the control method of the heat lamp 153 is switched from the second duty control to the first duty control in the operation state of the image forming apparatus 1 indicated by each value of the "apparatus state". The "threshold value"

includes a 'first threshold value', a 'second threshold value' and a 'third threshold value'. The 'first threshold value' indicates a first threshold value (hereinafter, referred to as the "first threshold value") used at the time the control method of the heat lamp 153 is switched from the second duty control to the first duty control. The threshold value is a predetermined value used at the time of being compared with the use amount of the heat lamp 153. The 'second threshold value' is a second threshold value (hereinafter referred to as the "second threshold value") used at the time the control method of the heat lamp 153 is switched from the second duty control to the first duty control. The 'third threshold value' indicates a third threshold value (hereinafter referred to as the "third threshold value") used at the time the control method of the heat lamp 153 is switched from the second duty control to the first duty control.

In the decoloring printing, the decoloring toner must be heated at a temperature equal to or higher than a temperature at which the decoloring toner is fixed and lower than a temperature at which the decoloring toner is decolorized. Therefore, it is preferable that the decoloring printing is executed by the second duty control described below capable of controlling the temperature with higher accuracy than the first duty control. Therefore, the first threshold value is set higher than the second threshold value.

Returning to the description of FIG. 4, the heat lamp controller 25 controls the heat lamp 153. The heat lamp controller 25 is, for example, a CPU. The heat lamp controller 25 sends a signal indicating that the heat lamp 153 is controlled to the use amount acquisition section 22. The signal indicating that the heat lamp 153 is controlled may be a signal indicating that the heat lamp 153 is turned on or a signal indicating that the heat lamp 153 is turned off.

Figure 7:
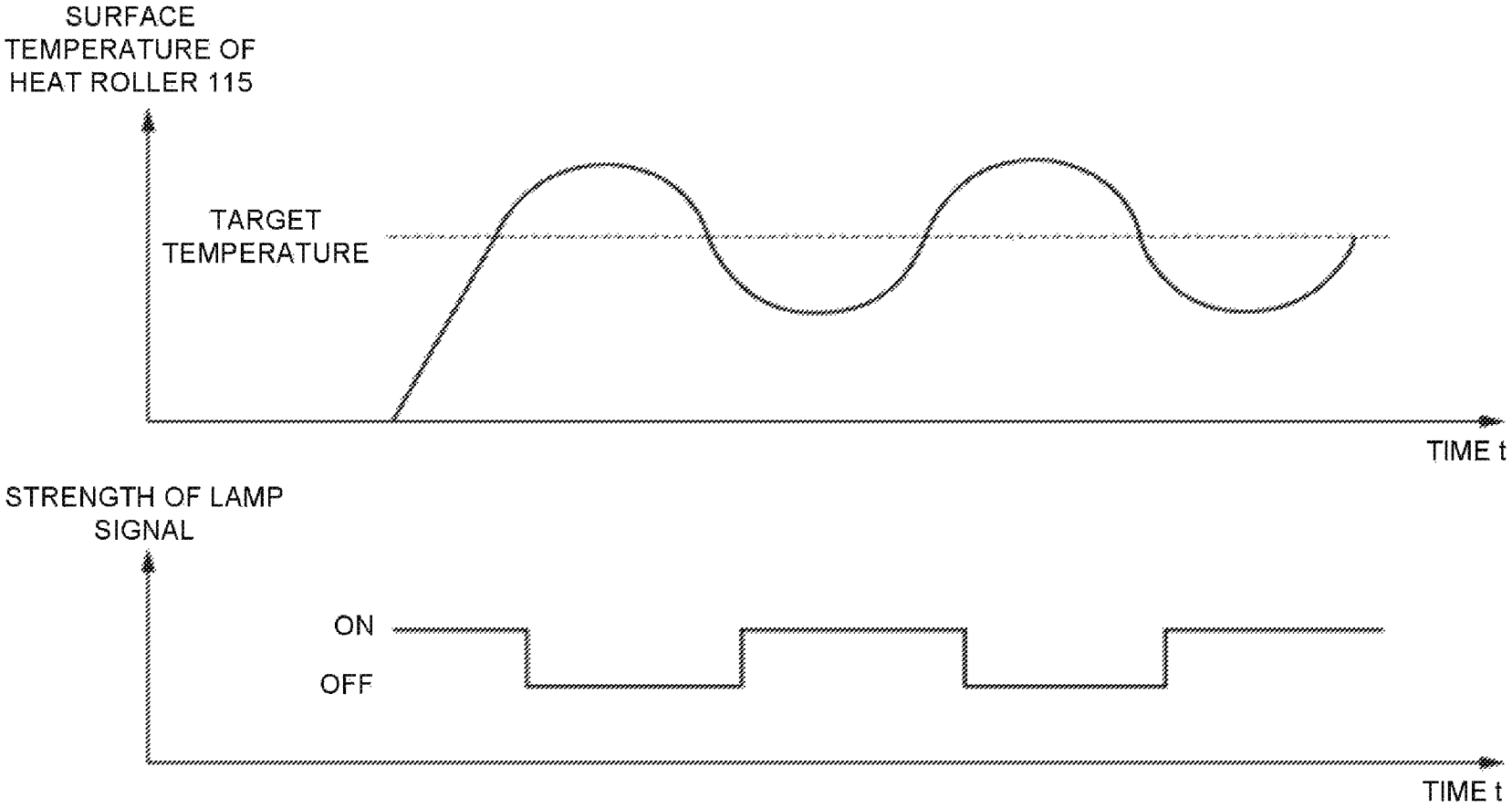
FIG. 7 is a diagram illustrating the relationship between a first duty control and a surface temperature of a heat roller according to the embodiment.

FIG. 7 is a diagram illustrating the relationship between the first duty control and the surface temperature of the heat roller 151 according to the embodiment. The first duty control switches the lighting (ON) and extinction (OFF) of the heat lamp 153 (hereinafter, referred to as "ON/OFF of the lamp") at the same cycle as the temperature change. As shown in FIG. 7, if the surface temperature of the heat roller 151 exceeds the target temperature, the duty controller 231 turns off the heat lamp 153. If the surface temperature of the heat roller 151 is lower than the target temperature, the duty controller 231 turns on the heat lamp 153. The first duty control switches ON/OFF of the lamp if the surface temperature of the heat lamp 153 is coincident with the target temperature. The target temperature is the surface temperature of the heat roller 151 preset to execute the image forming processing or the decoloring processing and is the fixing temperature of the toner.

Figure 8:
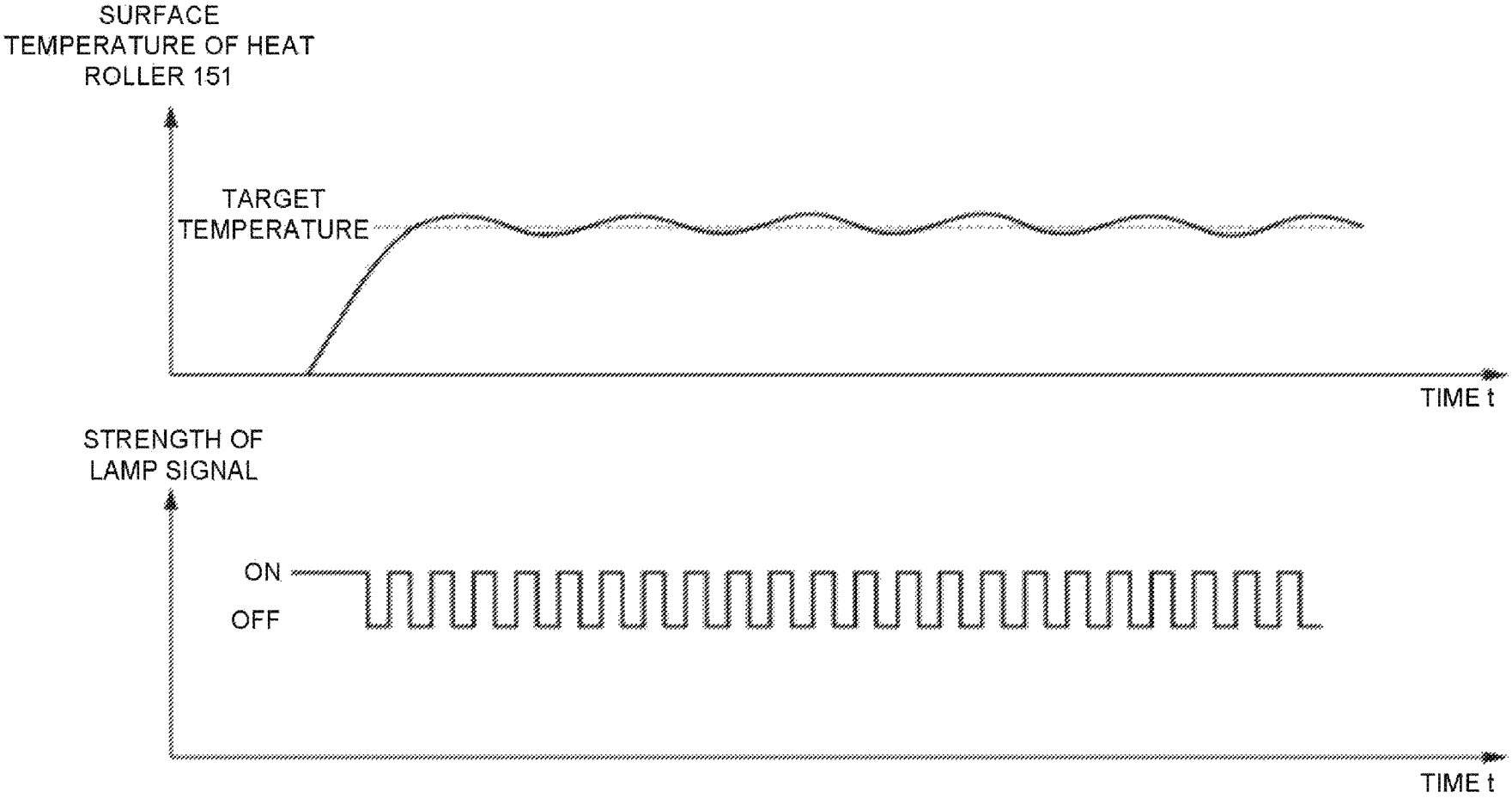
FIG. 8 is a diagram illustrating a temperature change in the surface temperature of the heat roller in a case of switching lighting and extinction of a heat lamp in a cycle shorter than a cycle of the temperature change.

FIG. 8 is a diagram illustrating the temperature change in the surface temperature of the heat roller 151 in a case of switching lighting and extinction of the heat lamp 153 in a cycle shorter than the cycle of the temperature change. In the control shown in FIG. 8, the lamp is turned on until the surface temperature of the heat roller 151 reaches the target temperature. If the surface temperature of the heat roller 151 reaches the target temperature, the lighting and extinction of the heat lamp 153 are switched in a cycle shorter than the cycle of the temperature change. In this way, by switching ON/OFF of the lamp, the surface temperature of the heat roller 151 is controlled more accurately than control by the first duty control.

Figure 9:
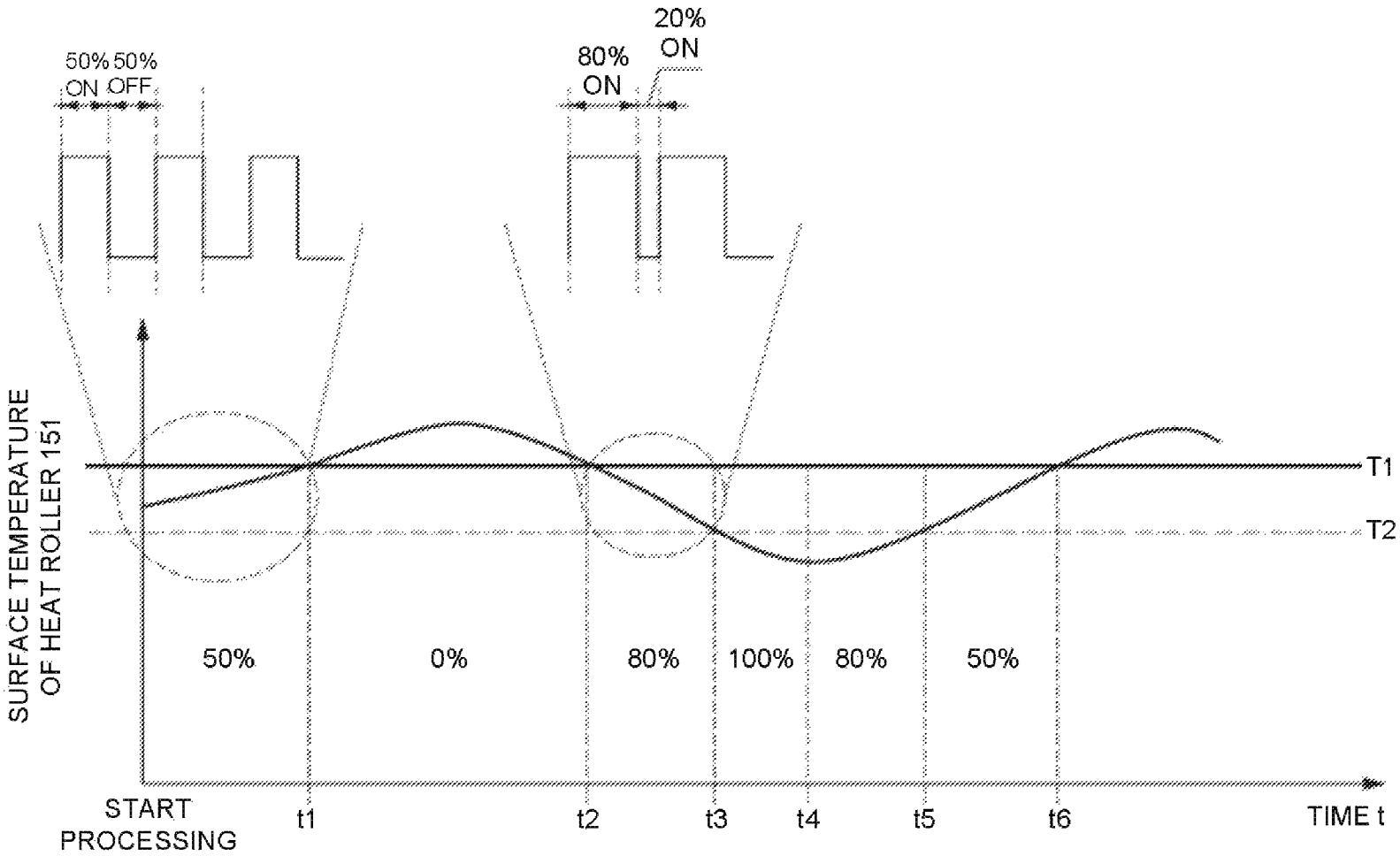
FIG. 9 is a diagram illustrating the relationship between a second duty control and the surface temperature of the heat roller according to the present embodiment.

FIG. 9 is a diagram illustrating the relationship between the second duty control and the surface temperature of the heat roller 151 according to the present embodiment. The second duty control switches ON/OFF of the lamp in the shorter cycle than the first duty control. Furthermore, the second duty control changes the duty ratio in one cycle to a predetermined duty ratio under a predetermined condition based on the surface temperature of the heat roller 151. The second duty control switches ON/OFF of the lamp in a shorter cycle than the first duty control, and thus, the surface temperature of the heat roller 151 is controlled more accurately than the first duty control. Furthermore, in the second duty control, the duty ratio is changed based on the surface temperature of the heat roller 151. Therefore, in the control of the surface temperature of the heat roller 151 by the second duty control, the surface temperature of the heat roller 151 is simply controlled more accurately than the control for switching ON/OFF of the lamp in the short cycle.

The information indicating the predetermined condition based on the surface temperature of the heat roller 151 and the predetermined duty ratio after the change corresponding to the predetermined condition is stored in the auxiliary storage device 24 as the second duty control table D101 shown in FIG. 5.

As shown in FIG. 9, the surface temperature of the heat roller 151 rises from the start of processing to a time t1, and the surface temperature of the heat roller 151 is equal to or higher than the temperature T1 and lower than temperature T2. The temperature matches the content shown by the "condition" of R2 in the second duty control table D101. Therefore, during this period, the duty controller 231 switches ON/OFF of the lamp depending on the contents indicated by the "control content" of the record of R2 in the second duty control table D101. The duty controller 231 executes control in which the duty ratio is 50%. The duty controller 231 starts the control in which the duty ratio of the heat lamp 153 is 50% at the timing of zero crossing. The timing of zero crossing means the timing of the zero crossing of an AC voltage supplied by the power source of the image forming apparatus 1.

In the second duty control, the time of one cycle for switching ON/OFF of the lamp is set to be sufficiently shorter than that of the temperature change of the heat roller 151 in advance.

In this way, the second duty control controls the surface temperature of the heat roller 151 more accurately than the control by the first duty control.

Figure 10:
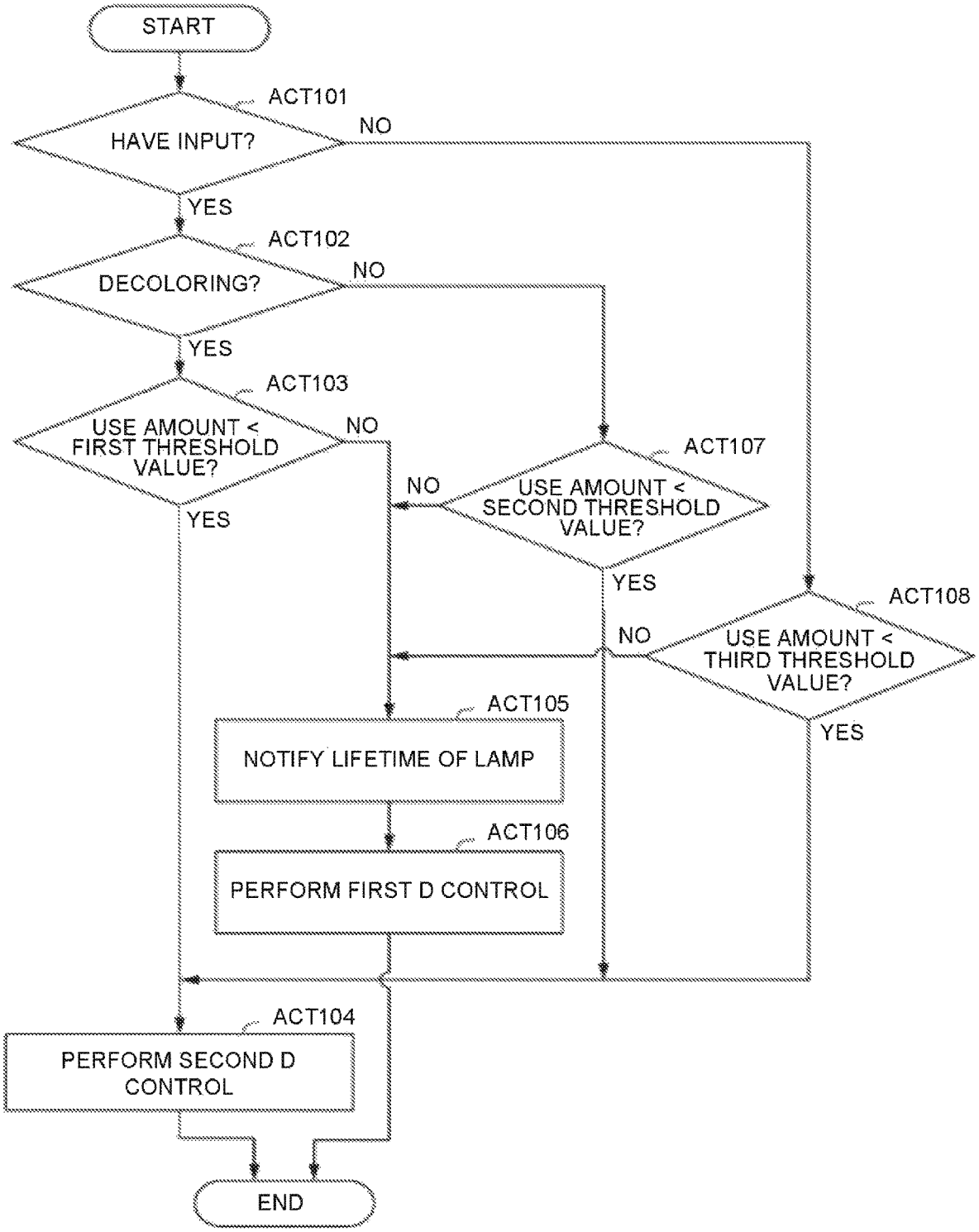
FIG. 10 is a flowchart illustrating the flow of a processing by the image forming apparatus according to the present embodiment.

FIG. 10 is a flowchart illustrating the flow of a processing by the image forming apparatus 1 according to the present embodiment. In the processing of FIG. 10, it is assumed that the duty controller 231 acquires the information indicating the surface temperature of the heat roller 151 acquired by the thermistor 154 at predetermined intervals. The processing is executed by a processing different from the processing shown in FIG. 10.

The control method switching section 232 determines whether or not the information instructing the image forming processing is input to the control panel 18 (ACT 101). If the information instructing the image forming processing is input to the control panel 18 (Yes in ACT 101), the control method switching section 232 determines whether or not the information instructing the image forming processing input to the control panel 18 is the information instructing the decoloring printing (ACT 102). If the information instructing the input image forming processing is an input for instructing the decoloring printing (Yes in ACT 102), the operation state of the image forming apparatus 1 is in the state of executing the decoloring printing. Therefore, the control method switching section 232 refers to the control method switching condition table D201 to select a record having the 'printing by decoloring toner' as the value of the item of the 'apparatus state'. The control method switching section 232 acquires the value of the item of the "threshold value" from the selected record. In the control method switching condition table D201, the value of the item of the "threshold value" in the record having the 'printing by decoloring toner' for the value of the item of the "apparatus state" is the 'first threshold value'. If the use amount of the heat lamp 153 does not exceed the acquired value indicated by the 'first threshold value' (Yes in ACT 103), the duty controller 231 executes the second duty control (ACT 104). The control executed by the duty controller 231 is determined by the control method switching section 232. The use amount of the heat lamp 153 is acquired by the use amount acquisition section 22.

A "first D control" in FIG. 10 indicates the first duty control.

On the other hand, if the use amount of the heat lamp 153 in ACT 103 exceeds the value indicated by the 'first threshold value' acquired by the control method switching section 232 (No in ACT 103), the image forming apparatus 1 notifies that the life of heat lamp 153 is near (ACT 105). After the image forming apparatus 1 notifies that the life of the heat lamp 153 is coming to an end, the duty controller 231 executes the first duty control (ACT 106).

A "second D control" in FIG. 10 indicates the second duty control.

On the other hand, in ACT 102, if the information instructing the input image forming processing is an input instructing the non-decoloring printing (No in ACT 102), the operation state of the image forming apparatus 1 is in the state of executing the non-decoloring printing. Therefore, the control method switching section 232 refers to the control method switching condition table D201 to select a record having the 'printing by the non-decoloring toner' as the value of the item 'the apparatus state'. The control method switching section 232 acquires the value of the item "the threshold value" from the selected record. In the control method switching condition table D201, the value of the item "the threshold value" of the record having 'printing by the non-decoloring toner' in the value of the item of the 'apparatus state' is the 'second threshold value'. If the use amount of the heat lamp 153 does not exceed the acquired value indicated by the 'second threshold value' (Yes in ACT 107), the duty controller 231 executes the second duty control (ACT 104).

On the other hand, if the value indicated by the 'second threshold value' acquired by the control method switching section 232 in ACT 107 does not exceed the use amount of the heat lamp 153 (No in ACT 107), the image forming apparatus 1 notifies that the life of the heat lamp 153 is coming to an end (ACT 105). After the image forming apparatus 1 notifies that the life of the heat lamp 153 is coming to an end, the duty controller 231 executes the first duty control (ACT 106).

On the other hand, in ACT 101, if the information for instructing the image forming processing is not input to the control panel 18 (No in ACT 101), the operation state of the image forming apparatus 1 becomes the standby state. Therefore, the control method switching section 232 refers to the control method switching condition table D201 to select a record having 'standby' as the value of the item of the 'apparatus state'. The control method switching section 232 acquires the value of the item of the "threshold value" from the selected record. In the control method switching condition table D201, the value of the item of the "threshold value" in the record having 'standby' as the value of the item of the 'apparatus state' is the 'third threshold value'. If the use amount of the heat lamp 153 does not exceed the acquired value indicated by the 'third threshold value' (Yes in ACT 108), the duty controller 231 executes the second duty control (ACT 104).

On the other hand, if the acquired value indicated by the 'third threshold value' does not exceed the use amount of the heat lamp 153 (No in ACT 108), the image forming apparatus 1 indicates that the life of the life lamp 153 is coming to an end (ACT 105). After the image forming apparatus 1 notifies that the life of the heat lamp 153 is coming to an end, the duty controller 231 executes the first duty control (ACT 106).

Based on the use amount of the heat lamp 153, the image forming apparatus 1 constituted in this way can change the number of times of switching between lighting and extinction of the heat lamp 153 in the image forming processing or the decoloring processing, and thus, it is possible to prolong the life of the heat lamp 153.

(Modification)

The image forming apparatus 1 may change the cycle of ON/OFF switching of the lamp depending on the surface temperature of the heat roller 151 in the second duty control.

The image forming apparatus 1 may set two threshold values relating to the use amount of the heat lamp 153 for one operation state of the image forming apparatus 1. Further, at this time, in addition to the first duty control and the second duty control, a third duty control for switching the lighting and extinction of the heat lamp 153 may be newly executed. The third duty control switches the lighting and extinction of the light lamp 153 in a cycle or duty ratio different from that of the first duty control and the second duty control. The third duty control may switch the lighting and extinction of the heat lamp 153 in a shorter cycle than the second duty control. The third duty control may switch the lighting and extinction of the heat lamp 153 in a longer cycle than the second duty control.

The image forming apparatus 1 may set N (N is an integer of 3 or more) threshold values relating to the use amount of the heat lamp 153 for one operation state of the image forming apparatus 1. At this time, in a plurality (up to N−1) of control methods for switching the lighting and extinction of the light lamp 153 in a cycle or duty ratio different from that of the first and the second duty control, the switching of the lighting and extinction of the heat lamp 153 may be controlled.

The surface temperature of the heat roller 151 is an example of the temperature of the heat roller and the heat lamp 153 is an example of the lamp. The control method switching section 232 is an example of the cycle controller.

According to at least one embodiment described above, based on the use amount of the heat lamp 153, the number of times of switching the lighting and extinction of the heat lamp 153 in the image forming processing or the decoloring processing can be changed, and thus, it is possible to prolong the life of the heat lamp 153.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a heat roller that heats a sheet printed with a toner image;

a lamp that heats the heat roller;

a use amount acquisition section that acquires a use amount of the lamp;

a cycle controller that sets a cycle based on the use amount; and a switching controller that repeats a performance which the lamp is turned on and turned off in the cycle sets by the cycle controller.

2. The image forming apparatus according to claim 1, wherein a plurality of threshold values of the use amount for changing the cycle is predetermined, and if the use amount exceeds any one of the plurality of the plurality of the threshold values, the cycle controller changes the cycle corresponding to the exceeded threshold value.

3. The image forming apparatus according to claim 1, wherein a number of times of extinction of the lamp is acquired as the use amount of the lamp.

4. The image forming apparatus according to claim 1, wherein a number of times of lighting of the lamp is acquired as the use amount of the lamp.

5. The image forming apparatus according to claim 1, wherein a lighting time of the lamp is acquired as the use amount of the lamp.

6. The image forming apparatus according to claim 1, wherein a number of sheets on which image formation is executed is acquired as the use amount of the lamp.

7. The image forming apparatus according to claim 1, wherein the cycle controller changes the cycle to a longest cycle among predetermined control cycles if the sheet does not pass through the heat roller.

8. The image forming apparatus according to claim 1, wherein the use amount acquisition section notifies a user that the use amount reaches a predetermined value.

9. The image forming apparatus according to claim 1, wherein the cycle controller sets a threshold value of the use amount in a case in which the image forming apparatus fixes a toner image formed with a decoloring toner on the sheet to a value higher than a threshold value of the use amount if the image forming apparatus fixes a toner image formed with a non-decoloring toner on the sheet.

10. An image forming method, comprising:

heating a heat roller with a lamp;

heating a sheet printed with a toner image with the heat roller;

acquiring a use amount of the lamp;

setting a cycle based on the use amount; and repeating a processing from a moment at which the lamp is charged until the lamp is charged next after the lamp is not charged in a predetermined control cycle;

repeating turning on and turning off the lamp in the cycle sets.

11. The image forming method according to claim 10, wherein a plurality of threshold values of the use amount for changing the cycle is predetermined, further comprising:

changing the cycle corresponding to a new threshold value if the use amount exceeds any one of the plurality of the threshold values.

12. The image forming method according to claim 10, wherein acquiring the use amount of the lamp comprises acquiring a number of times of extinction of the lamp.

13. The image forming method according to claim 10, wherein acquiring the use amount of the lamp comprises acquiring a number of times of lighting of the lamp.

14. The image forming method according to claim 10, wherein acquiring the use amount of the lamp comprises acquiring a lighting time of the lamp.

15. The image forming method according to claim 10, wherein acquiring the use amount of the lamp comprises acquiring a number of sheets on which image formation is executed.

16. The image forming method according to claim 10, further comprising:

changing the cycle to a longest cycle among predetermined control cycles if the sheet does not pass through the heat roller.

17. The image forming method according to claim 10, further comprising:

notifying a user that the use amount reaches a predetermined value.

18. The image forming method according to claim 10, further comprising:

setting a threshold value of the use amount in a case in which the image forming apparatus fixes a toner image formed with a decoloring toner on the sheet to a value higher than a threshold value of the use amount if the image forming apparatus fixes a toner image formed with a non-decoloring toner on the sheet.

* * * * *